US008390206B2

(12) United States Patent
Ruxton

(10) Patent No.: US 8,390,206 B2
(45) Date of Patent: Mar. 5, 2013

(54) VARIABLE-EFFECT LIGHTING SYSTEM

(75) Inventor: James Ruxton, Hamilton (CA)

(73) Assignee: Pharos Innovations, Inc., Toronto (CA)

( * ) Notice: Subject to any disclaimer, the term of this patent is extended or adjusted under 35 U.S.C. 154(b) by 0 days.

(21) Appl. No.: 13/525,939

(22) Filed: Jun. 18, 2012

(65) Prior Publication Data

US 2012/0319600 A1 Dec. 20, 2012

Related U.S. Application Data

(63) Continuation of application No. 12/063,905, filed on Jul. 3, 2008, now Pat. No. 8,203,275.

(30) Foreign Application Priority Data

Aug. 16, 2005 (CN) ..... 2005 1 0092007

(51) Int. Cl.
*H05B 37/00* (2006.01)

(52) U.S. Cl. ..... 315/185 R; 315/224; 315/307

(58) Field of Classification Search ..... 315/224, 315/209 R, 291, 185 R, 193, 307, 308, 186, 315/192
See application file for complete search history.

(56) References Cited

U.S. PATENT DOCUMENTS

| | | | | |
|---|---|---|---|---|
| 7,573,210 | B2 * | 8/2009 | Ashdown et al. | 315/307 |
| 8,004,203 | B2 * | 8/2011 | Maxik | 315/247 |
| 2005/0040773 | A1 * | 2/2005 | Lebens et al. | 315/291 |

* cited by examiner

*Primary Examiner* — David H Vu
(74) *Attorney, Agent, or Firm* — Heenan Blaikie LLP

(57) ABSTRACT

A variable-effect lighting system includes a lamp assembly and a lamp controller coupled to the lamp assembly. The lamp assembly comprises a number of multi-colored lamps in series with an AC voltage source and in series with each other. Each multi-colored lamp comprises a first illuminating element for producing a first color of light, and a second illuminating element for producing a second color of light. The lamp controller is configured to control the current draw of each said illuminating element, and to adjust the current draw in accordance with the frequency of the voltage source.

12 Claims, 10 Drawing Sheets

VARIABLE-EFFECT LIGHTING SYSTEM

RELATED APPLICATIONS

This patent application is a continuation of U.S. patent application Ser. No. 12/063,905 (now U.S. Pat. No. 8,203,275), entitled "Variable-Effect Lighting System", filed Aug. 16, 2006.

FIELD

This patent application relates to variable-effect lighting systems. In particular, the patent application relates relates to a lighting system having coloured lamps for producing a myriad of colour displays.

BACKGROUND

Variable-effect lighting systems are commonly used for advertising, decoration, and ornamental or festive displays. Such lighting systems frequently include a set of coloured lamps packaged in a common fixture, and a control system which controls the output intensity of each lamp in order to control the colour of light emanating from the fixture.

For instance, Kazar (U.S. Pat. No. 5,008,595) teaches a light display comprising strings of bicoloured LED packages connected in parallel across a common DC voltage source. Each bicoloured LED package comprises a pair of red and green LEDs, connected back-to-back, with the bicoloured LED packages in each string being connected in parallel to the voltage source through an H-bridge circuit. A control circuit, connected to the H-bridge circuits, allows the red and green LEDS to conduct each alternate half cycle, with the conduction angle each half cycle being determined according to a modulating input source coupled to the control circuit. However, the rate of change of coloured light produced is restricted by the modulating input source. Therefore, the range of colour displays which can be produced by the light display is limited.

Phares (U.S. Pat. No. 5,420,482) teaches a controlled lighting system which allows a greater range of colour displays to be realized. The lighting system comprises a control system which transmits illumination data to a number of lighting modules. Each lighting module includes at least two lamps and a control unit connected to the lamps and responsive to the illumination data to individually vary the amount of light emitted from each lamp. However, the illumination data only controls the brightness of each lamp at any given instant. Therefore, the lighting system is not particularly well suited to easily producing intricate colour displays.

Murad (U.S. Pat. No. 4,317,071) teaches a computerized illumination system for producing a continuous variation in output colour. The illumination system comprises a number of different coloured lamps, a low frequency clock, and a control circuit connected to the low frequency clock and to each coloured lamp for varying the intensity of light produced by each lamp. However, the rate of change of lamp intensity is dictated by the frequency of the low frequency clock, and the range of colour displays is limited.

Gomoluch (GB 2,244,358) discloses a lighting control system which includes a lighting control unit, and a string of light units connected to the lighting control unit. The lighting control unit includes a DC power supply unit, a microprocessor, a read-only memory containing display bit sequences, and switches for allowing users to select a display bit sequence. Each light unit includes a bi-coloured LED, and data storage elements each connected in parallel to the DC power output of the lighting control unit and in series with data and clock outputs of the microprocessor. The microprocessor clocks the selected bit patterns in serial fashion to the storage elements. The data storage elements received each data bit, and illuminate or extinguish the associated LED.

However, Gomoluch requires that complex light units be used. Therefore, there remains a need for a relatively simple variable-effect lighting system which allows for greater variation in the range of colour displays which can be realized.

SUMMARY

This patent application describes a variable-effect lighting system comprising a lamp assembly, and a lamp controller coupled to the lamp assembly.

In a first aspect of this patent application, the lamp assembly comprises a plurality of multi-coloured lamps in series with an AC voltage source and in series with each other. Each multi-coloured lamp comprises a first illuminating element for producing a first colour of light, and a second illuminating element for producing a second colour of light. The lamp controller is configured to vary the colour produced by the lamps by varying a conduction interval of each said illuminating element according to a predetermined pattern. The controller is also configured to terminate the variation upon activation of a user-operable input to the controller.

In a second aspect of this patent application, the lamp assembly comprises a plurality of multi-coloured lamps in series with an AC voltage source and in series with each other. Each multi-coloured lamp comprises a first illuminating element for producing a first colour of light, and a second illuminating element for producing a second colour of light. The lamp controller is configured to vary the colour produced by the lamps by varying the conduction interval of each illuminating element according to an external signal input to the lamp controller.

In a third aspect of this patent application, the lamp assembly comprises a plurality of multi-coloured lamps in series with an AC voltage source and in series with each other. Each multi-coloured lamp comprises a first illuminating element for producing a first colour of light, and a second illuminating element for producing a second colour of light. The lamp controller is configured to control the current draw of each said illuminating element in accordance with the frequency of the voltage source.

In a fourth aspect of this patent application, the variable-effect lighting system includes a first lamp assembly comprising a plurality of first multi-coloured lamps in parallel with an AC voltage source and in series with each other, and a first lamp controller coupled to the first lamp assembly for controlling a first colour of light produced by the first multi-coloured lamps. The lighting system also includes a second lamp assembly comprising a plurality of second multi-coloured lamps in parallel with the AC voltage source and in series with each other; and a second lamp controller coupled to the second lamp assembly for controlling a second colour of light produced by the second multi-coloured lamps. The first lamp controller is configured to vary the first produced colour. The second lamp controller is configured to vary the second produced colour in synchronization with the first produced colour.

In a fifth aspect of this patent application, the lamp assembly comprises a plurality of multi-coloured lamps in parallel with a DC voltage source. Each multi-coloured lamp comprises a first illuminating element for producing a first colour of light, and a second illuminating element for producing a second colour of light different from the first colour. The lamp controller includes a first electronic switch coupled to all of the first illuminating elements and a second electronic switch coupled to all of the second illuminating elements. The lamp controller is configured to set the conduction angle of each illuminating element according to at least one predetermined pattern, the controller being configured with the predetermined patterns.

BRIEF DESCRIPTION OF THE DRAWINGS

The foregoing aspects will now be described in detail, by way of example only, with reference to the drawings, in which.

DETAILED DESCRIPTION

Figure 1A:
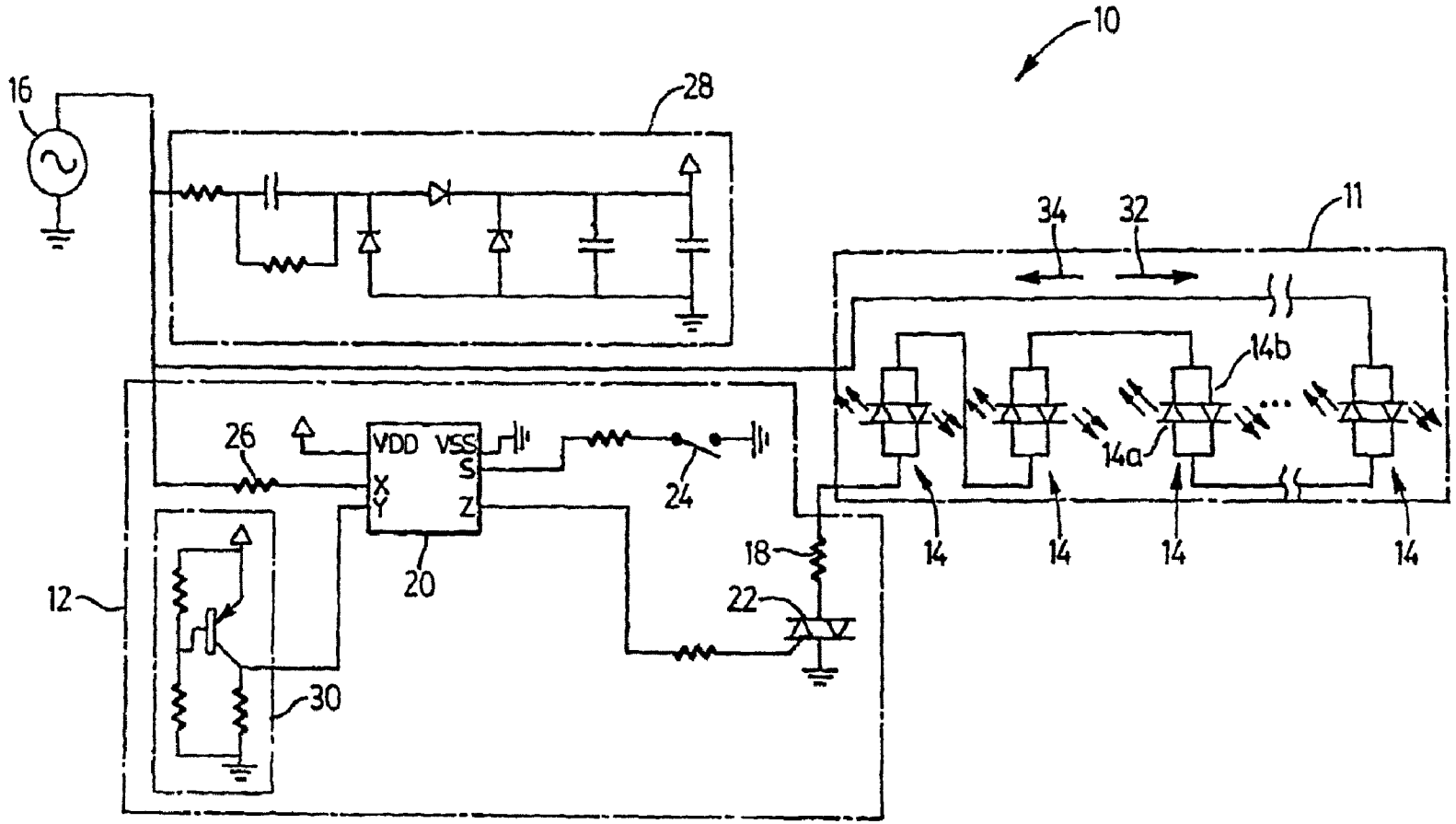
FIG. 1*a* is a schematic circuit diagram of a first embodiment of the variable-effect lighting system, showing a lamp controller, and a lamp assembly comprising a string of series-coupled bicoloured lamps.

Turning to FIG. 1*a*, a variable-effect lighting system, denoted generally as 10, is shown comprising a lamp assembly 11, and a lamp controller 12 coupled to the lamp assembly 11 for setting the colour of light produced by the lamp assembly 11. Preferably, the lamp assembly 11 comprises string of multi-coloured lamps 14 interconnected with flexible wire conductors to allow the ornamental lighting system 10 to be used as decorative Christmas tree lights. However, the multi-coloured lamps 14 may also be interconnected with substantially rigid wire conductors or affixed to a substantially rigid backing for applications requiring the lamp assembly 11 to have a measure of rigidity.

The multi-coloured lamps 14 are connected in series with each other and with an AC voltage source 16, and a current-limiting resistor 18. Typically the AC voltage source 16 comprises the 60 Hz 120 VAC source commonly available. However, other sources of AC voltage may be used without departing from the scope of the invention. As will be appreciated, the series arrangement of the lamps 14 eliminates the need for a step-down transformer between the AC voltage source 16 and the lamp assembly 11. The current-limiting resistor 18 limits the magnitude of current flowing through the lamps 14. However, the current-limiting resistor 18 may be eliminated if a sufficient number of lamps 14 are used, or if the magnitude of the voltage produced by the AC voltage source 16 is selected so that the lamps 14 will not be exposed to excessive current flow.

Preferably, each lamp 14 comprises a bicoloured LED having a first illuminating element for producing a first colour of light, and a second illuminating element for producing a second colour of light which is different from the first colour, and with the leads of each lamp 14 disposed such that when current flows through the lamp 14 in one direction the first colour of light is produced, and when current flows through the lamp 14 in the opposite direction the second colour of light is produced. As shown in FIG. 1*a*, preferably each bicoloured LED comprises a pair of differently-coloured LEDs 14*a*, 14*b* connected back-to-back, with the first illuminating element comprising the LED 14*a* and the second illuminating element comprising the LED 14*b*.

In a preferred implementation, the first illuminating element produces red light, and the second illuminating element produces green light. However, other LED colours may be used if desired. In addition, both LEDs 14*a*, 14*b* of some of the lamps 14 may be of the same colour if it is desired that some of the lamps 14 vary the intensity of their respective colour outputs only. Further, each lamp 14 may be fitted with a translucent ornamental bulb shaped as a star, or a flower or may have any other aesthetically pleasing shape for added versatility.

Preferably, the lamp controller 12 comprises a microcontroller 20, a bidirectional semiconductor switch 22 controlled by an output Z of the microcontroller 20, and a user-operable switch 24 coupled to an input S of the microcontroller 20 for selecting the colour display desired. In addition, an input X of the microcontroller 20 is coupled to the AC voltage source 16 through a current-limiting resistor 26 for synchronization purposes, as will be described below. The bidirectional switch 22 is positioned in series with the lamps 14, between the current limiting resistor 18 and ground. In FIG. 1*a*, the bidirectional switch 22 is shown comprising a triac switch. However, other bidirectional switches, such as IGBTs or back-to-back SCRs, may be used without departing from the scope of the invention.

The lamp controller 12 is powered by a 5-volt DC regulated power supply 28 connected to the AC voltage source 16 which ensures that the microcontroller 20 receives a steady voltage supply for proper operation. However, for added safety, the lamp controller 12 also includes a brownout detector 30 connected to an input Y of the microcontroller 20 for placing the microcontroller 20 in a stable operational mode should the supply voltage to the microcontroller 20 drop below acceptable limits.

Preferably, the microcontroller 20 includes a non-volatile memory which is programmed or "burned-in" with preferably several conduction angle patterns for setting the conduction angle of the bidirectional switch 22 in accordance with the pattern selected. In this manner, the conduction angles of the LEDs 14*a*, 14*b* (and hence the colour display generated by the bicoloured lamps 14) can be selected. Alternately, the microcontroller 20 may be replaced with a dedicated integrated circuit (ASIC) that is "hard-wired" with one or more conduction angle patterns.

Preferred colour displays include, but are not limited to:

1. continuous slow colour change between red, amber and green 2. continuous rapid colour change between red, amber and green 3. continuous alternate flashing of red and green
4. continuous random flashing of red and green
5. continuous illumination of red only
6. continuous change in intensity of red
7. continuous flashing of red only
8. continuous illumination of green only
9. continuous change in intensity of green
10. continuous flashing of green only
11. continuous illumination of red and green to produce amber
12. combination of any of the preceding colour displays However, as will be appreciated, the microcontroller 20 need only be programmed with a single conduction angle pattern to function. Further, the microcontroller 20 needs only to be programmed in situ with a user interface (not shown) for increased flexibility. As will be apparent, if the microcontroller 20 is programmed with only a single conduction angle pattern, the user-operable switch 24 may be eliminated from the lamp controller 12. Further, the user-operable switch 24 may be eliminated even when the microcontroller 20 is programmed with a number of conduction angle patterns, with the microcontroller 20 automatically switching between the various conduction angle patterns. Alternately, the user-operable switch 24 may be replaced with a clock circuit which signals the microcontroller 20 to switch conduction angle patterns according to the time.

The operation of the variable-effect lighting system 10 will now be described. Prior to power-up of the lighting system 10, the microcontroller 20 is programmed with at least one conduction angle pattern. Alternately, the microcontroller 20 is programmed after power-up using the above-described user interface. Once power is applied through the AC voltage source 16, the 5-volt DC regulated power supply 28 provides power to the microcontroller 20 and the brown-out detector 30.

After the brown-out detector 30 signals the microcontroller 20 at input Y that the voltage supplied by the power supply 28 has reached the threshold sufficient for proper operation of the microcontroller 20, the microcontroller 20 begins executing instructions for implementing a default conduction angle pattern. However, if a change of state is detected at the input S by reason of the user activating the user-operable switch 24, the microcontroller 20 will begin executing instructions for implementing the next conduction angle pattern. For instance, if the microcontroller 20 is executing instructions for implementing the third conduction angle pattern identified above, actuation of the user-operable switch 24 will force the microcontroller 20 to being executing instructions for implementing the fourth conduction angle pattern.

For ease of explanation, it is convenient to assume that the LED 14*a* is a red LED, and the LED 14*b* is a green LED. It is also convenient to assume that the first conduction angle pattern, identified above, is selected. The operation of the lighting system 10 for the remaining conduction angle patterns will be readily understood from the following description by those skilled in the art.

After the conduction angle pattern is selected, either by default or by reason of activation of the user-operable switch 24, the microcontroller 20 will begin monitoring the AC signal received at the input X to the microcontroller 20. Once a positive-going zero-crossing of the AC voltage source 16 is detected, the microcontroller 20 delays a predetermined period. After the predetermined period has elapsed, the microcontroller 20 issues a pulse to the bidirectional switch 22, causing the bidirectional switch 22 to conduct current in the direction denoted by the arrow 32. As a result, the red LED 14*a* illuminates until the next zero-crossing of the AC voltage source 16. In addition, while the LED 14*a* is conducting current, the predetermined period for the LED 14*a* is increased in preparation for the next positive-going zero-crossing of the AC voltage source 16.

After the negative-going zero-crossing of the AC signal source 16 is detected at the input X, the microcontroller 20 again delays a predetermined period. After the predetermined period has elapsed, the microcontroller 20 issues a pulse to the bidirectional switch 22, causing the bidirectional switch 22 to conduct current in the direction denoted by the arrow 34. As a result, the green LED 14*b* illuminates until the next zero-crossing of the AC voltage source 16. In addition, while the LED 14*b* is conducting current, the predetermined period for the LED 14*b* is decreased in preparation for the next negative-going zero-crossing of the AC voltage source 16.

With the above conduction angle sequence, it will be apparent that the period of time each cycle during which the red LED 14*a* illuminates will continually decrease, while the period of time each cycle during which the green LED 14*b* illuminates will continually increase. Therefore, the colour of light emanating from the bicoloured lamps 14 will gradually change from red, to amber, to green, with the colour of light emanating from the lamps 14 when both the LEDs 14*a*, 14*b* are conducting being determined by the instantaneous ratio of the magnitude of the conduction angle of the LED 14*a* to the magnitude of the conduction angle of the LED 14*b*.

When the conduction angle of the green LED 14*b* reaches 180°, the conduction angle pattern is reversed so that the colour of light emanating from the bicoloured lamps 14 changes from green, to amber and back to red. As will be appreciated, the maximum conduction angles for each conducting element of the lamps 14 can be set less than 180° if desired.

In a preferred implementation, the microcontroller 20 comprises a Microchip PIC12C508 microcontroller. The zero-crossings of the AC voltage source 16 are detected at pin 3, the state of the user-operable switch 24 is detected at pin 7, and the bidirectional switch 22 is controlled by pin 6. The brown-out detector 30 is coupled to pin 4.

A sample assembly code listing for generating conduction angle patterns 1, 2 and 3 with the Microchip PIC12C508 microcontroller is shown in Table A.

TABLE A

```
; Constants
  AC_IN EQU 4; GP4 (pin 3) is AC input pin X
  TRIGGER_OUT EQU 1; GP1 (pin 6) is Triac Trigger pin Z
  BUTTON EQU 0; GP0 (pin 7) is input pin S and is active low
  delay_dim EQU 0x007
  dim_val EQU 0x008
  trigger_delay EQU 0x009
  DELAY1 EQU 0x00A
  DELAY2 EQU 0x00B
  DELAY3 EQU 0x00C
  RED_INTENSITY EQU 0x00D
  SUBTRACT_REG EQU 0x00E
  DELAY5 EQU 0x00F
  FLASH_COUNT EQU 0x010
  FLASH_COUNT_SHAD EQU 0x011
  FADE_DELAY EQU 0x012
  org 0; RESET vector location
  movwf OSCCAL; move data from W register to OSCCAL
  goto START
DELAY; subroutine to delay 83 usec * register W
  movwf dim_val;
LOOP1
  movlw .27
  movwf delay_dim
LOOP2; delay 83 usec
  decfsz delay_dim,1
```

TABLE A-continued

```
   goto LOOP2
   decfsz dim_va1,1
   goto LOOP1
return
TRIGGER; subroutine to send trigger pulse to triac
   bsf GPIO,TRIGGER_OUT
      movlw b'00010001'
      TRIS GPIO; send trigger to triac
   movlw .30
   movwf trigger_delay
LOOP3
   decfsz trigger_delay,1
   goto LOOP3; delay 30 usec
      movlw b'00010011'
      TRIS GPIO; remove trigger from triac
return
DELAY_SEC
   movlw .4
   movwf DELAY3;          set DELAY3
SEC2
   movlw .250
   movwf DELAY2;          set DELAY2
QUART_SEC2
   movlw .250
   movwf DELAY1;          set DELAY1
MSEC2
   clrwdt;     clear Watchdog timer
   decfsz DELAY1,1;       wait DELAY1
   goto MSEC2
   decfsz DELAY2,1;       wait DELAY2 * DELAY1
   goto QUART_SEC2
   decfsz DELAY3,1:       wait DELAY3 * DELAY2 * DELAY1
   goto SEC2
return
FADE_SUB;                 subroutine to vary conduction angle for triac
                          each half cycle
UP_LOOP;                  increase delay before triac starts to conduct
                          each negative half cycle while decreasing delay
                          each positive half cycle
   btfss GPIO,AC_IN
   goto UP_LOOP;          wait for positive swing on AC input
WAIT_NEG1
   call WAIT_NEG_EDGE1; increase delay before turning triacon each
                          negative half cycle
NO_CHANGE
   movlw .90; register W = maximum delay value
            before triac turns on
   subwf RED_INTENSITY,0
   btfsc STATUS,Z
   goto WAIT_NEG2; if RED_INTENSITY is equal to maximum
                  delay value, start increasing delay value
   movf RED_INTENSITY,0
   btfss GPIO,BUTTON
return;                   return if Button depressed
   call DELAY;            delay RED_INTENSITY * 83 usec
   call TRIGGER;          send trigger pulse to triac
MAIN_LOOP2
   btfsc GPIO,AC_IN
   goto MAIN_LOOP2; wait for negative swing on AC input
WAIT_POS_EDGE1
   btfss GPIO,AC_IN
   goto WAIT_POS_EDGE1; wait for positive swing on AC input
   movlw .96
   movwf SUBTRACT_REG; SUBTRACT_REG = maximum
                       delay value + minimum delay value
                       before triac turns on
   movf RED_INTENSITY,0
   subwf SUBTRACT_REG,0
   call DELAY; delay (SUBTRACT_RED-RED_
              INTENSITY) * 83 usec
   call TRIGGER; send trigger pulse to triac
   goto UP_LOOP
DOWN_LOOP
   btfss GPIO,AC_IN
   goto DOWN_LOOP; wait for positive swing on AC input
WAIT_NEG2
   call WAIT_NEG_EDGE2;   decrease delay before triac turns on each
                          negative half cycle
NO_CHANGE2
   movlw .6
```

TABLE A-continued

```
   subwf RED_INTENSITY,0; register W = RED_INTENSITY –
                          minimum delay value
   btfsc STATUS,Z
   goto WAIT_NEG1; if RED_INTENSITY is equal to minimum delay
                   value, start increasing delay
   movf RED_INTENSITY,0
   btfss GPIO,BUTTON
return;                   return if Button depressed
   call DELAY;            delay RED_INTENSITY * 83 usec
   call TRIGGER;          send trigger pulse to triac
MAIN_LOOP3
   btfsc GPIO,AC_IN
   goto MAIN_LOOP3; wait for negative swing on AC input
WAIT_POS_EDGE2
   btfss GPIO,AC_IN
   goto WAIT_POS_EDGE2; wait for positive swing on AC input
   movlw .96
   movwf SUBTRACT_REG; SUBTRACT_ REG = maximum delay
                       value before triac turns on
   movf RED_INTENSITY,0
   subwf SUBTRACT_REG,0
   call DELAY; delay (SUBTRACT_REG-RED_INTENSITY) * 83 usec
   call TRIGGER; send trigger pulse to triac
   goto DOWN_LOOP
return
WAIT_NEG_EDGE1; routine to increase delay before triac turns
      ; on each negative half cycle
   btfsc GPIO,AC_IN; wait for negative swing on AC input
   goto WAIT_NEG_EDGE1
   decfsz DELAY5,1; DELAY5 = fade delay (number of cycles at
                   present delay) value; decrement and
                   return if not zero
return
   incf RED_INTENSITY,1; otherwise, increment delay and return
   movf FADE_DELAY,0
   movwf DELAY5
return
WAIT_NEG_EDGE2; routine to decrease delay before triac turns
                on each negative half cycle
   btfsc GPIO,AC_IN; wait for negative swing on AC input
   goto WAIT_NEG_EDGE2
   decfsz DELAY5,1; DELAY5 = number of cycles at present
                   delay value; decrement and return if not zero
return
   decf RED_INTENSITY,1; otherwise decrement delay and return
   movf FADE_DELAY,0
   movwf DELAY5; DELAY5 = FADE_DELAY
return
FLASH_SUB; subroutine to flash lights at speed dictated by
value assigned to FLASH_COUNT_SHAD
   movf FLASH_COUNT_SHAD,0
   movwf FLASH_COUNT; FLASH_COUNT = duration of flash
MAIN_LOOP4
   btfsc CPIO,AC_IN; wait for negative swing on AC input
   goto MAIN_LOOP4
WAIT_POS_EDGE4
   btfsc GPIO,AC_IN
   goto WAIT_POS_EDGE4; wait for positive swing on AC input
   movlw .6
   call DELAY
   call TRIGGER; send trigger pulse to triac
   btfss GPIO,BUTTON
return; return if Button pressed
   decfsz FLASH_COUNT
   goto MAIN_LOOP4; decrement FLASH_COUNT and
   repeat until zero
   movf FLASH_COUNT_SHAD,0
   movwf FLASH_COUNT; reset FLASH_COUNT
DOWN_LOOP4
   btfss GPIO,AC_IN; wait for positive swing on AC input
   goto DOWN_LOOP4
WAIT_NEG_EDGE4
   btfsc GPIO,AC_IN
   goto WAIT_NEG_EDGE4; wait for negative swing on AC input
   movlw .6
   call DELAY
   call TRIGGER send trigger pulse to triac
   btfss GPIO,BUTTON
return; return if Button pressed
   decfsz FLASH_COUNT
```

TABLE A-continued

```
  goto DOWN_LOOP4; decrement FLASH_COUNT and
  repeat until zero
return
START
  movlw b'00010011'
  TRIS GPIO; set pins GP4 (AC input), GP1 (Triac output to high
  impedance), GPO (Button as input)
  movlw b'10010111'; enable pullups on GPO, GP1, GP3
OPTION
  movlw .4
  movwf RED_INTENSITY; load RED_INTENSITY register
  movlw .5
  movwf DELAY5; set initial fade
FADE_SLOW
  call DELAY_SEC; wait DELAY3 * DELAY2 * DELAY1
  movlw .5
  movwf FADE_DELAY; set slow FADE_DELAY
  call FADE_SUB; slowly fade colours until Button is pressed
  goto FADE_FAST
FADE_FAST
  call DELAY_SEC; wait DELAY3 * DELAY2 * DELAY1
  movlw .1
  movwf FADE_DELAY; set fast FADE_DELAY
  call FADE_SUB; rapidly fade colours until Button is pressed
  goto FLASH2_SEC
FLASH2_SEC ; flash red/green 2 sec interval
  call DELAY_SEC; wait DELAY3 * DELAY2 * DELAY1
  movlw .120
  movwf FLASH_COUNT_SHAD
FLASH2B_SEC
  btfss GPIO,BUTTON
  goto FLASH1_SEC; slowly flash lights until Button is pressed
  call FLASH_SUB
  goto FLASH2B_SEC
FLASH1_SEC ; flash red/green 1 sec. interval
  call DELAY_SEC; wait DELAY3 * DELAY2 * DELAY1
  movlw .60
  movwf FLASH_COUNT_SHAD
FLASH1B_SEC
  btfss GPIO,BUTTON
  goto FLASH_FAST; flash lights at moderate speed until
Button is pressed
  call FLASH_SUB
  goto FLASH1B_SEC
FLASH_FAST ; flash red/green 0.25 sec. interval
  call DELAY_SEC; wait DELAY3 * DELAY2 * DELAY1
  movlw .15
  movwf FLASH_COUNT_SHAD
FLASH_FASTB
  btfss GPIO,BUTTON
  goto FADE_SLOW; rapidly flash lights until Button is pressed
  call FLASH_SUB; slowly fade colours if Button is pressed
  goto FLASH_FASTB
end
```

Numerous variations of the lighting system 10 are possible. In one variation (not shown), the user-operable switch 24 is replaced with a temperature sensor coupled to the input S of the microcontroller 20 for varying the conduction angle pattern according to the ambient temperature. Alternately, the lamp controller 12 includes a plurality of temperature sensors, each being sensitive to a different temperature range, and being coupled to a respective input of the microcontroller 20. With this variation, one colour display is produced when the ambient temperature falls within one range and another colour display is produced when the ambient temperature falls within a different range.

In another variation, the lamp controller 12 includes a motion or proximity sensor coupled to an appropriate input of the microcontroller 20. With this variation, one colour display is produced when motion or an object (such as a person) is detected, and another colour display is produced when no motion or object is detected.

Figure 1B:
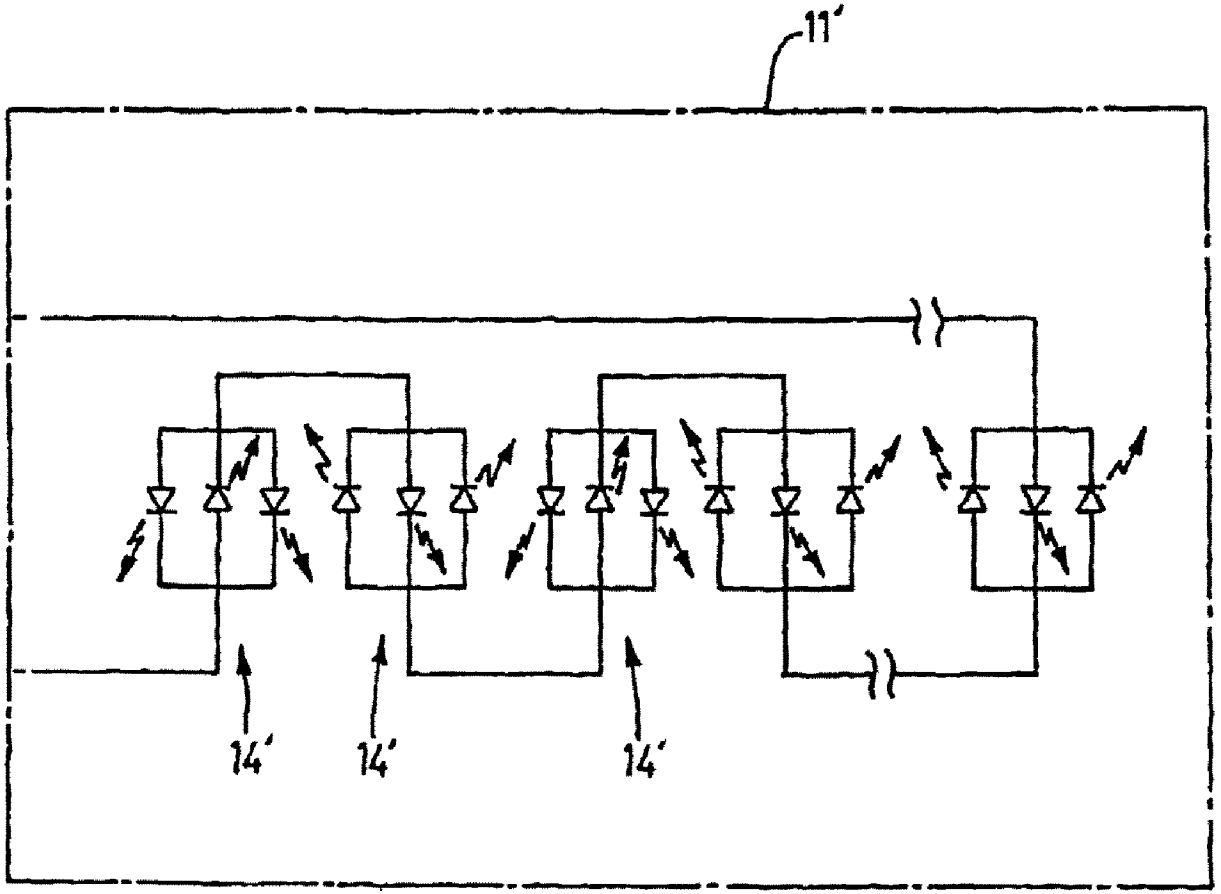
FIG. 1*b* is a schematic circuit diagram of one variation of the lamp assembly shown in FIG. 1*a;*

In yet another variation (not shown), each lamp 14 comprises a pair of LEDs with one of the LEDs being capable of emitting white light and with the other of the LEDs being capable of producing a colour of light other than white. In still another variation, each lamp 14 comprises a LED capable of producing three or more different colours of light, while in the variation shown in FIG. 1*b*, each lamp 14 comprises three or more differently-coloured LEDs. In these latter two variations, the LEDs are connected such that when current flows in one direction one colour of light is produced, and when current flows in the opposite direction another colour of light is produced.

Figure 1C:
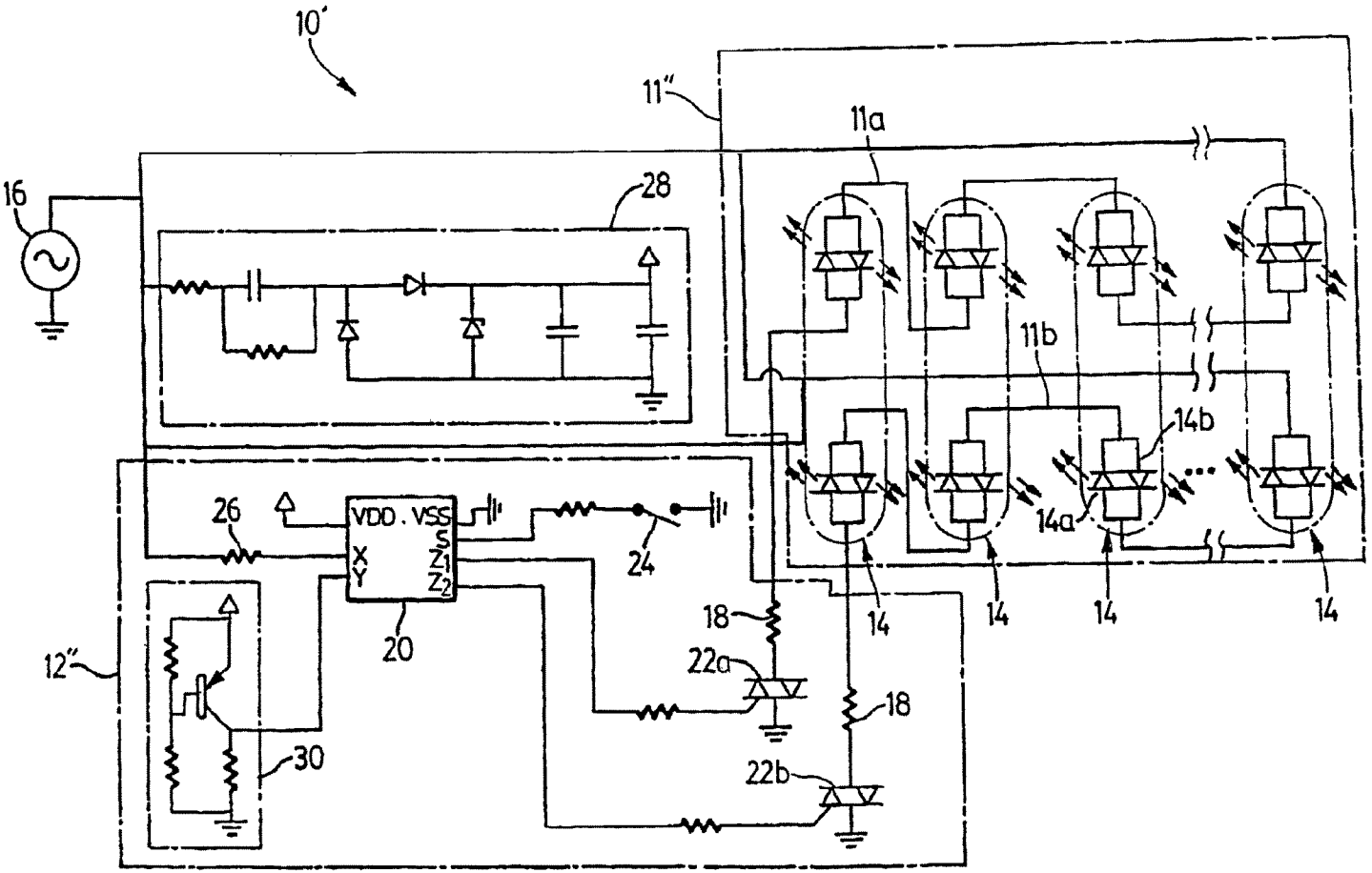
FIG. 1*c* is a schematic circuit diagram of a variable-effect lighting system, according to a second embodiment of the variable-effect lighting system.

A second embodiment of the lighting system is depicted in FIG. 1*c*. As shown, the lamp controller 12 comprises two bidirectional switches 22*a*, 22*b* each connected to a respective output Z1, Z2 of the microcontroller 20. The lamp assembly 11 comprises first and second strings 11*a*, 11*b* of series-connected back-to-back-coupled LEDs 14*a*, 14*b*, with each string 11*a*, 11*b* being connected to the AC voltage source 16 and to a respective one of the bidirectional switches 22*a*, 22*b*. In this variation, each multi-coloured lamp 14 comprises one pair of the back-to-back-coupled LEDs 14*a*, 14*b* of the first string 11*a* and one pair of the back-to-back-coupled LEDs 14*a*, 14*b* of the second string 11*b*, with the LEDs of each lamp 14 being inserted in a respective translucent ornamental bulb. As a result, the colour of light emanating from each bulb depends on the instantaneous ratio of the conduction angles of the LEDs 14*a*, 14*b* in both strings 11*a*, 11*b*. Preferably, the outputs Z1, Z2 are independently operable to increase the range of colour displays.

In one variation, the lamp controller 12 is similar to the lamp controller 12 shown in FIG. 1*c*, in that it comprises two bidirectional switches 22*a*, 22*b* each connected to a respective independently-operable output Z1, Z2 of the microcontroller 20. However, unlike the lamp controller 12 shown in FIG. 1*c*, the lamp assembly 11 comprises first and second strings 11*a*, 11*b* of series-connected single-coloured lamps 14. As above, each singly-coloured lamp 14 of the first string 11*a* is associated with a singly-coloured lamp 14 of the second string 11*b*, with each associated lamp pair being inserted in a respective translucent ornamental bulb.

Figure 1D:
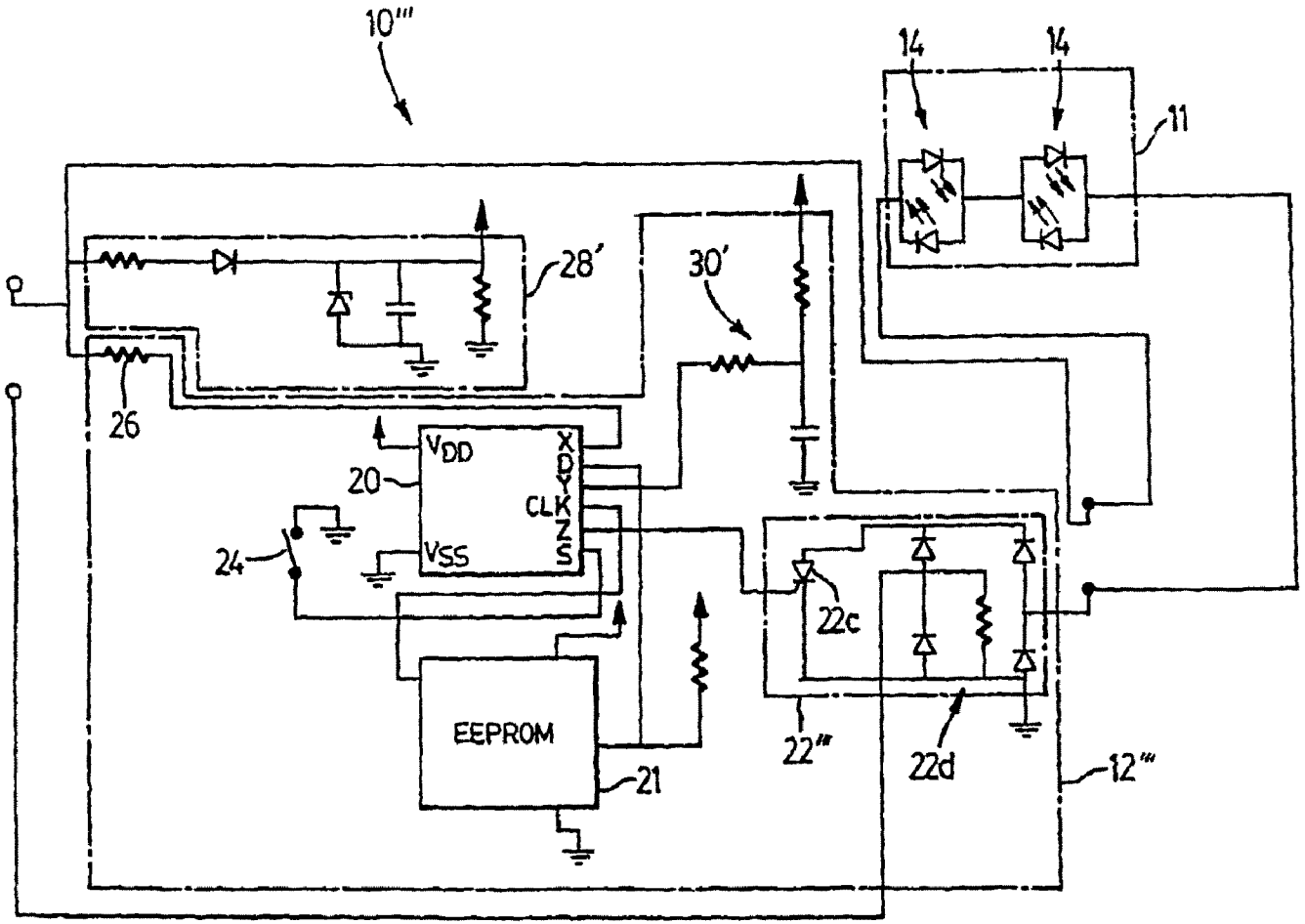
FIG. 1*d* is a schematic circuit diagram of a third embodiment of the variable-effect lighting system.

A third embodiment of the lighting system is depicted in FIG. 1*d*. As shown, the lighting system 10''' comprises a RC power-up circuit 30' for placing the microcontroller 20 in a known state at power up, and an EEPROM 21 connected to the microcontroller 20 for retaining a data element identifying the selected conduction angle pattern so that the lighting system 110''' implements the previously selected conduction angle pattern after power up. As will be apparent, the EEPROM 21 may be implemented instead as part of the microcontroller 20.

The bidirectional semiconductor switch 22''' of the lamp controller 12''' of the lighting system 10''' comprises a thyristor 22*c*, and a diode H-bridge 22*d*. The thyristor 22*c* is connected at its gate input to the output Z of the microcontroller 20. The diode H-bridge 22*d* is connected between the anode of the thyristor 22*c* and the lamp assembly 11. The diode H-bridge 22*d* comprises two legs of two series-connected diodes, and a 1 Meg-ohm resistor connected between one of the diode legs and signal ground for providing the microcontroller 20 with a fixed voltage reference for proper operation of the diode bridge 22*d*. The bidirectional switch 22''' functions in a manner similar to the semiconductor switch 22, but is advantageous since the cost of a thyristor is generally less than that of a triac.

Figure 1E:
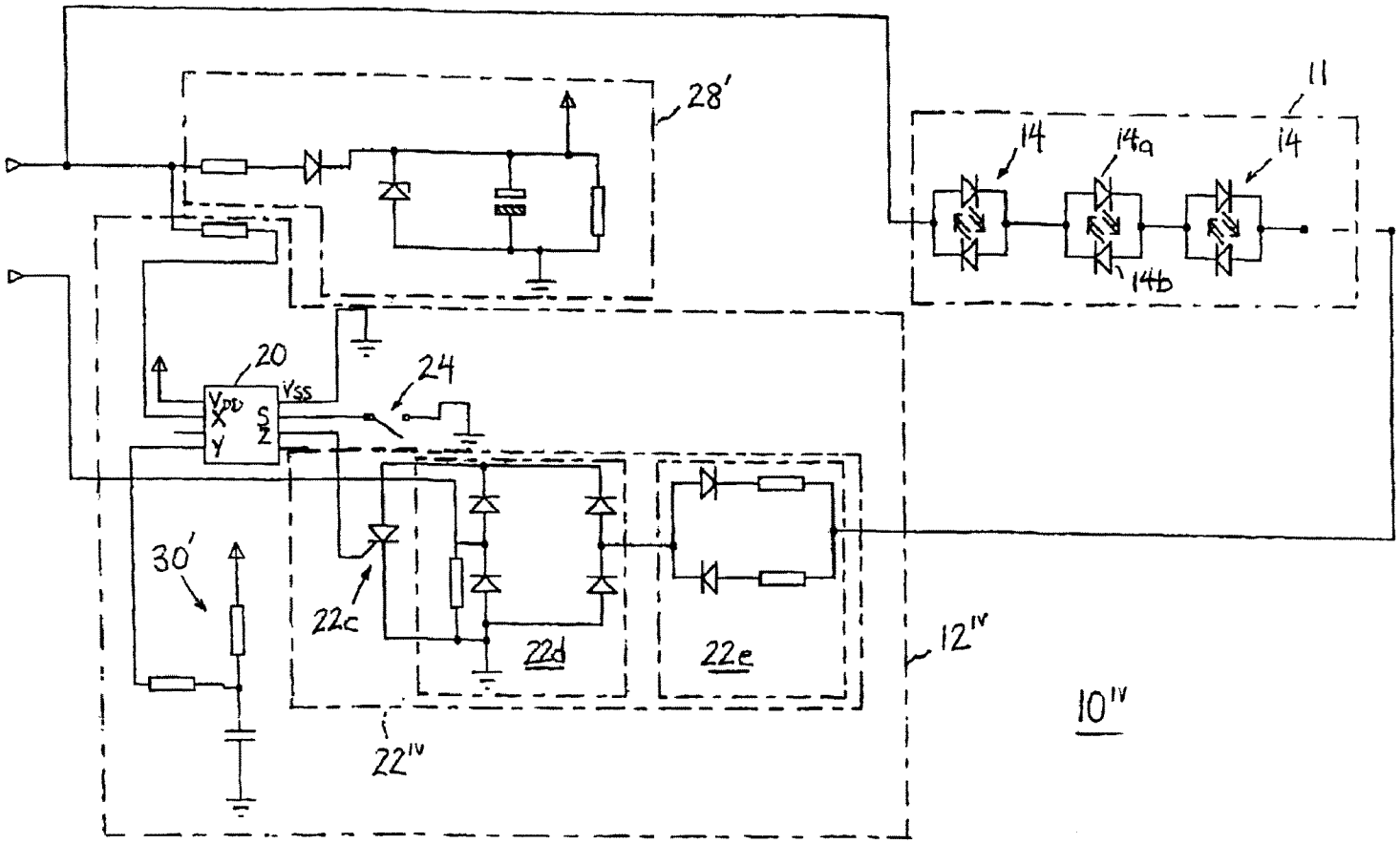
FIG. 1*e* is a schematic circuit diagram of a fourth embodiment of the variable-effect lighting system.

A fourth embodiment of the lighting system is depicted in FIG. 1*e*. As shown, the bidirectional semiconductor switch $\mathbf{22}^{iv}$ of the lamp controller $\mathbf{12}^{iv}$ of the lighting system $\mathbf{10}^{iv}$ comprises the thyristor 22*c*, the diode H-bridge 22*d* and a diode steering section 22*e*. The thyristor 22*c* is connected at its gate input to the output Z of the microcontroller 20. The diode H-bridge 22*d* is connected to the anode of the thyristor 22*c*, and the diode steering section 22*e* is connected between the diode H-bridge 22*d* and the lamp assembly 11.

The diode steering section 22*e* comprises a first steering diode in series with a first current-limiting resistor, and a second steering diode in series with a second current-limiting resistor. As shown, the first steering diode is connected at its anode to the diode H-bridge 22*d*, and is connected at its cathode to the first current-limiting resistor. The second steering diode is connected at its cathode to the diode H-bridge 22*d*, and is connected at its anode to the second current-limiting resistor.

In operation, when current flows from the voltage source through the lamps 14 in a first direction, the current is steered by the first steering diode through the first current-limiting resistor. When current flows from the voltage source through the lamps 14 in a second (opposite direction), the current is steered by the second steering diode through the second current-limiting resistor.

Typically, the forward voltage of the LEDs 14*a* may not be identical to the forward voltage of the LEDs 14*b*. As a result, generally the current conducted by the LEDs 14*a* may not be identical to the current conducted by the LEDs 14*b*. Therefore, the intensity of light produced by the LEDs 14*a* might not be identical to the intensity of light produced by the LEDs 14*b*. Further, even if the forward voltage of the LEDs 14*a* is the same as the forward voltage of the LEDs 14*b*, the intensity of light produced by the LEDs 14*a* might still not be identical to the intensity of light produced by the LEDs 14*b*. Using the diode steering section 22*e*, the intensity of light produced by the LEDs 14*a* can be matched to the intensity of light produced by the LEDs 14*b* by the appropriate selection of the values for the first and second current limiting resistors.

Although the diode steering section 22*e* is depicted in FIG. 1*e* as a separate circuit from the diode H-bridge 22*d*, the functionality of the diode steering section 22*e* can be incorporated into the diode H-bridge 22*d*, by relocating the first and second current-limiting resistors of the diode steering section 22*e* into respective legs of the diode H-bridge 22*d*, and eliminating the first and steering diodes. In this variant, the diodes of the H-bridge 22*d* would, in effect, perform the same function as the first and second steering diodes.

Further, the first and second current-limiting resistors of the diode steering section 22*e* are depicted in FIG. 1*e* as fixed resistances. However, the thyristor 22*c* and the diode H-bridge 22*d* can be eliminated, and the first and second current-limiting resistors replaced with electrically-variable resistors controlled by the microcontroller 20. In this latter variant, the intensity/colour produced by each lamp 14 can be controlled without having to calculate the conduction interval for each illuminating element 14*a*, 14*b*.

Thus far in the discussion, it has been assumed that the frequency of the AC voltage source has been constant. In the algorithm implemented in the assembly code listing shown in Table A, it was assumed that the frequency of the AC voltage source was constant at 60 Hz. In practice, the frequency of the AC voltage source might not be constant. Alternately, the frequency of the AC voltage source might be constant at some value other than 60 Hz. For instance, in some countries, the AC voltage is delivered to households at approximately 50 Hz. In either of these cases, the lamp controller 12 configured with the algorithm implemented in the assembly code listing shown in Table A would produce unpredictable results since the remaining conduction intervals calculated by the algorithm for each half cycle of the voltage source will not reflect the actual remaining conduction intervals.

Specifically, if the frequency of the voltage source is lower than expected, the period of the voltage source will be longer than expected. A point will be reached where the algorithm assumes that the LEDs 14*a* are fully on, and the LEDs 14*b* are fully off, at which point the algorithm will begin to reverse (i.e. will decrease the conduction interval of the LEDs 14*a*, and will increase the conduction interval of the LEDs 14*b*). However, at this point, the LEDs 14*a* will not be fully on, and the LEDs 14*b* will note be fully off. As a result, the colour produced by each lamp 14 will not be as expected.

Conversely, if the frequency of the voltage source is higher than expected, the period of the voltage source will be shorter than expected. A point will be reached where the LEDs 14*a* are fully on, and the LEDs 14*b* are fully off. However, at this point, the algorithm will assume that the LEDs 14*a* are not quite fully on, and the LEDs 14*b* are not quite fully off, at which point the algorithm will continue to increase the conduction interval of the LEDs 14*a*, and will continue to decrease the conduction interval of the LEDs 14*b*. As a result, the LEDs 14*a*, 14*b* will be turned on during the wrong half of the voltage cycle, thereby producing an unpredictable visual display.

Accordingly, rather than the algorithm assuming a fixed source voltage frequency, preferably the algorithm implemented by the lamp controller 12 (in any of the preceding embodiments of the lighting system) measures the period of time between instances of zero voltage crossings of the AC source voltage, and uses the calculated period to calculate the line frequency of the AC source voltage. By using the calculated line frequency, the algorithm is able to accurately track the actual conduction interval for the LEDs 14 during each half cycle of the AC voltage. The algorithm can calculate the line frequency on a cycle-by-cycle basis. However, for greater accuracy, preferably the algorithm calculates the line frequency over several AC voltage cycles.

Thus far in this description, the user-operable switch 24 has been used to cycle between the different conduction angle patterns. According to a fifth embodiment, the lamp controller is configured with only a single conduction angle algorithm, such as a continuous colour change or a continuous intensity change, and the user-operable switch 24 is used to start/stop the variation in the conduction angle. As a result, the user is able to fix or set the colour or intensity produced by the lamp assembly as desired, by simply depressing the user-operable switch 24 when the lamp controller has produced the desired colour or intensity. As above, preferably the current conduction angle is stored in EEPROM when the user-operable switch 24 is activated so that the lamp controller 12 reimplements the selected colour or intensity, using the stored conduction angle, after power has been removed and then reapplied to the lighting system.

If the user wishes to select a different colour or intensity, the user depresses the user-operable switch 24 again, thereby causing the conduction angle algorithm to resume the variation in colour or intensity. The user then presses the user-operable switch 24 again when the lamp controller has produced the new desired colour or intensity.

A sample assembly code listing for fixing the desired colour using a Microchip PIC 12F629 microcontroller as the microcontroller 20 is shown below in Table B.

TABLE B

```
; The program consists of a fade routine in which the conduction angles of
; two sets of series-connected LEDs (connected back-to-back) are changed.
; During the SCR trigger pulse, the user-operable switch 24 is monitored.
; Activation of the switch 24 toggles a FLAG. If the switch 24 is pressed
; when the fade is occurring, the current conduction angles are kept
; steady. These values are also stored in EEPROM so that the information
; is retained in the event of a power loss. On power up, the previous
; state is retrieved from the EEPROM.
   LIST P = 12f629, F = INHX8M
        LIST FREE
      #include "p12f629.inc"
 ; Constants
Start_Stop EQU 0
Button EQU 0 ; Button on GPIO,0
AC_IN EQU 5 ; AC input on GPIO,5
TRIGGER_OUT EQU 1; Triac Trigger on GPIO,1
min intensity EQU .80 ; values for min and max delays of trigger pulse
max intensity EQU .30
Flag Address EQU 0 ; location where start/stop status is stored
Intensity Address EQU 1 ; location where current intensity is stored
Position_Address EQU 2 ; location which says where in the fade
routine program was ;
stopped
; variables
delay_dim EQU 0×020
dim val EQU O×021
trigger_delay EQU 0×022
RED_INTENSITY EQU 0×023
SUBTRACT_REG EQU 0×024
DELAY5 EQU 0×025
FADE_DELAY EQU 0×026
FLAG EQU 0×027
Dlay EQU 0×028
DELAY1 equ 0×029
DELAY2 equ 0×02a
DELAY3 equ 0×02b
ADDRESS equ 0×02C
DATA_B equ 0×02D
POSITION EQU 0×02E
   ORG 0×000 ; processor reset vector
   goto start ; go to beginning of program
org 0×007
WAIT_NEG_EDGE1 ; wait here till negative going pulse
   btfsc GPIO,AC_IN
   goto WAIT_NEG_EDGE1
   decfsz DELAY5,1; after FADE_DELAY counted down, increase
   RED_INTENSITY
   return
   btfss FLAG,Start_Stop ; if flag set, don't fade
      ; (i.e. don't increment intensity register)
   incf RED_INTENSITY,1
   movf FADE_DELAY,0
   movwf DELAY5
   return
WAIT_NEG_EDGE2
   btfsc GPIO,AC_IN
   goto WAIT_NEG_EDGE2
   decfsz DELAY5,1; after FADE_DELAY counted down, decrease
   RED_INTENSITY
   return
   btfss FLAG,Start_Stop ; if flag set, don't decrement intensity register
   decf RED_INTENSITY,1
   movf FADE_DELAY,0
   movwf DELAY5
   return
start
   call 0×3FF ; retrieve factory calibration value
   bsf STATUS,RP0 ; set file register bank to 1
   movwf OSCCAL ; update register with factory cal value
   movlw b'00000001' ; enable pullup on GPIO,0
   movwf WPU
   bcf STATUS,RP0 ; set file register bank to 0
   bcf FLAG,Start_Stop ; reset fade stop flag
   movlw b00000111'
   movwf CMCON
   movlw b00101011 ; GPO button input, GP1 trigger SCR
                   ; GP3 Reset, GPO A.C. timing pulse
   TRIS GPIO
   movlw b00011111' ; prescale wdt 128,
```

TABLE B-continued

```
   OPTION
   movlw max intensity
   movwf RED_INTENSITY
   movlw .7 ;
   movwf DELAY5 ; counter for FADE_DELAY determines fade speed
   movwf FADE_DELAY
   movlw Flag_Address ; check state (1 = fade stopped, 0 = fade)
   movwf ADDRESS
   call EE_READ
   movf DATA_B,0
   movwf FLAG ; only one bit used so can use reg.
   btfss FLAG,Start_Stop ;if fade stopped get intensity
   goto FADE_SLOWB ; otherwise continue
   movlw Intensity_Address
   movwf ADDRESS ; get intensity value
   call EE_READ
   movf DATA_B,0
   movwf RED_INTENSITY
   movlw Position Address ; find out where in program it was stopped
   movwf ADDRESS
   call EE_READ
   movf DATA_B,0
   movwf POSITION ; save position in POSITION variable
   movlw .1 ; determine where in program too jump to
   subwf POSITION,0
   btfsc STATUS,Z
   call POSITION1
   movlw .2
   subwf POSITION,0
   btfsc STATUS,Z
   call POSITION2
   movlw .3
   subwf POSITION,0
   btfsc STATUS,Z
   call POSITION3
   movlw .4
   subwf POSITION,0
   btfsc STATUS,Z
   call POSITION4
FADE_SLOWB ; fade between colors
   movlw .7 ; determines fade speed ie. 1 would be a fast fade
   movwf FADE_DELAY
   call WAIT_NEG1 ;
   movlw max_intensity
   movwf RED_INTENSITY
   goto FADE_SLOWB
DELAY
   movwf dim_val ; used to set up time to trigger scr
LOOP1
   movlw .27
   movwf delay_dim
LOOP2 decfsz delay_dim,1
   goto LOOP2
   decfsz dim_val,1
   goto LOOP1
   return
EE_READ ; routines to read and write to EEPROM
   movf ADDRESS,0
   bsf STATUS,RP0
   movwf EEADR
   bsf EECON1,RD
   movf EEDATA,w
   bcf STATUS,RP0
   movwf DATA_B
   return
EE_WRITE
   movf DATA_B,0
   bsf STATUS,RP0
   movwf EEDATA
   bcf STATUS,RP0
   movf ADDRESS,0
   bsf STATUS,RP0
   movwf EEADR
   bsf EECON1,WREN
   movlw 55h
   movwf EECON2
   movlw 0×0AA
   movwf EECON2
   bsf EECON1,WR
```

TABLE B-continued

```
Write_Loop
   btfsc EECON1,WR
   goto Write_Loop ; stay in loop till complete
   bcf EECON1,WREN
   bcf STATUS,RP0
   return
Check_Button
   movlw .4 ; check button and debounce
   movwf DELAY3
SEC2
   movlw .25
   movwf DELAY2
QUART_SEC2
   movlw .250
   movwf DELAY1
MSEC2
   clrwdt
   decfsz DELAY1,1
   goto MSEC2
   decfsz DELAY2,1
   goto QUART_SEC2
   decfsz DELAY3,1
   goto SEC2
   btfss GPIO,Button
   goto $-1
   movlw .4
   movwf DELAY3
SEC3
   movlw .250
   movwf DELAY2
QUART_SEC3
   movlw .25
   movwf DELAY1
MSEC3
   clrwdt
   decfsz DELAY1,1
   goto MSEC3
   decfsz DELAY2,1
   goto QUART_SEC3
   decfsz DELAY3,1
   goto SEC3
   movlw b'00000001' ;when button pressed toggle flag from stopped
         ; to fade position
   xorwf FLAG,1
   movlw Flag_Address
   movwf ADDRESS
   movf FLAG,0
   movwf DATA_B
   call EE_WRITE ; save values in EEPROM
   movlw Intensity_Address
   movwf ADDRESS
   movf RED_INTENSITY,0
   movwf DATA_B
   call EE_WRITE
   movlw Position_Address
   movwf ADDRESS
   movf POSITION,0
   movwf DATA_B
   call EE_WRITE
   return
TRIGGER      ; trigger pulse to SCR
             ; button press is checked during each trigger pulse
   clrwdt
   bsf GPIO,TRIGGER_OUT
   movlw b'00101001' ;
   TRIS GPIO
   movlw .30
   movwf trigger_delay
LOOP3
   decfsz trigger_delay,1
   goto LOOP3
   bcf GPIO,TRIGGER_OUT
   movlw b'00101011' ;
   TRIS GPIO
   btfss GPIO,Button ; if button pressed check it
   call Check_Button
   return
FADE_SUB ; subroutine for fading (4 positions in fade sequence)
```

TABLE B-continued

```
UP_LOOP
POSITION1
   movlw .1
   movwf POSITION
   btfss GPIO,AC_IN ;
   goto UP_LOOP ; RED LOOP
WAIT_NEG1
   call WAIT_NEG_EDGE1
NO_CHANGE
   movlw min_intensity ;
   subwf RED_INTENSITY,0
   btfsc STATUS,Z
   goto WAIT_NEG2 ;DOWN_LOOP
   movf RED_INTENSITY,0 ; (RED_INTENSITY-min_intensity)
   call DELAY
   call TRIGGER
MAIN_LOOP2
   btfsc GPIO,AC_IN
   goto MAIN LOOP2
WAIT_POS_EDGE1
   btfss GPIO,AC_IN
   goto WAIT_POS_EDGE1
   movlw max_intensity
   call DELAY
   call TRIGGER
   goto UP_LOOP
DOWN_LOOP
POSITION2
   movlw .2
   movwf POSITION
   btfss GPIO,AC_IN
   goto DOWN_LOOP
WAIT_NEG2
   call WAIT_NEG_EDGE2
NO_CHANGE2
   movlw max_intensity
   subwf RED_INTENSITY,0
   btfsc STATUS,Z
   goto GREEN_DOWN_RED_ON
   movf RED_INTENSITY,0
   call DELAY
   call TRIGGER
MAIN_LOOP3
   btfsc GPIO,AC_IN ;
   goto MAIN_LOOP3
WAIT_POS_EDGE2
   btfss GPIO,AC_IN
   goto WAIT_POS_EDGE2
   movlw max_intensity
   call DELAY
   call TRIGGER
   goto DOWN_LOOP
GREEN_DOWN_RED_ON
   movlw min_intensity
   movwf RED_INTENSITY
   goto WAIT_NEG2C
GREEN_DOWN_RED_ONB
POSITION3
   movlw .3
   movwf POSITION
   btfss GPIO,AC_IN ;
   goto GREEN_DOWN_RED_ONB
WAIT_NEG2C
   call WAIT_NEG_EDGE2
NO_CHANGE2C
   movlw max_intensity
   subwf RED_INTENSITY,0
   btfsc STATUS,Z
   goto WAIT_NEG1C
   movlw max_intensity
   call DELAY
   call TRIGGER
MAIN_LOOP3C
   btfsc GPIO,AC_IN
   goto MAIN_LOOP3C
WAIT_POS_EDGE2C
   btfss GPIO,AC_IN
   goto WAIT_POS_EDGE2C
   movlw min_intensity+max_intensity
   movwf SUBTRACT_REG
```

TABLE B-continued

```
  movf RED_INTENSITY,0
  subwf SUBTRACT_REG,0
  call DELAY
  call TRIGGER
  goto GREEN_DOWN_RED_ONB
GREEN_UP_RED_ON
POSITION4
  movlw .4
  movwf POSITION
  btfss GPIO,AC_IN ;
  goto GREEN_UP_RED_ON
WAIT_NEG1C
  call WAIT_NEG_EDGE1
NO_CHANGEC
  movlw min_intensity
  subwf RED_INTENSITY,0
  btfss STATUS,Z
  goto Continue_Loop
  movlw max_intensity ;start over
  movwf RED_INTENSITY
  goto WAIT_NEG1
Continue_Loop
  movlw max_intensity
  call DELAY
  call TRIGGER
MAIN_LOOP2C
  btfsc GPIO,AC_IN ;
  goto MAIN_LOOP2C
WAIT_POS_EDGE1C
btfss GPIO,AC_IN
  goto WAIT_POS_EDGE1C
  movlw max_intensity+min_intensity
  movwf SUBTRACT_REG
  movf RED_INTENSITY,0
  subwf SUBTRACT_REG,0
  call DELAY
  call TRIGGER
  goto GREEN_UP_RED_ON
      ;
  end
```

In a sixth embodiment (not shown), the lamp controller includes two user-operable inputs, and implements both the colour/intensity selection algorithm of the fifth embodiment and the multiple conduction angle pattern algorithms of the first through fourth embodiments. In this sixth embodiment, one of the user-operable inputs is used to select the desired conduction angle pattern, and the other user-operable inputs is used to start/stop the selected conduction angle pattern at a desired point.

An inherent advantage of each of the preceding embodiments is that they are all self-synchronizing. For instance, in each the preceding embodiments, if multiple lamp controllers were powered by a common AC voltage source, and were configured with the same predetermined display pattern(s), the visual display produced by each corresponding lamp assembly would be synchronized with the visual display produced by the other lamp assemblies. Thus, for example, in a household environment where several 120 VAC receptacles are connected in parallel with the same voltage source, all lamp assemblies would be synchronized with one another, even if the corresponding lamp controllers were plugged into different receptacles.

In each of the foregoing sample algorithms, the value of the RED_INTENSITY variable is increased/decreased after FADE_DELAY iterations of the WAIT_NEG_EDGE1 and WAIT_NEG_EDGE2 subroutines. Since the value of the RED_INTENSITY variable determines the conduction interval of each of the LEDs 14, the rate of change of the colour produced by the lamp assembly is fixed by the value assigned to the FADE_DELAY variable. In a seventh embodiment, the rate of change of colour is not fixed but is determined by a signal source external to the lamp controller. In this embodiment, instead of the WAIT_NEG_EDGE1 and WAIT_NEG_EDGE2 subroutines increasing/decreasing the value of the RED_INTENSITY variable at a predetermined rate, the algorithm increases/decreases the value assigned to the RED_INTENSITY variable based on an external signal. Preferably, the value assigned to the RED_INTENSITY variable is based on a digital signal applied to the lamp controller, such as a DMX signal. However, in one variation, the microcontroller includes an analog-to-digital converter, and the value assigned to the RED_INTENSITY variable is based on the magnitude of an analog signal applied to the input of the analog-to-digital converter. An advantage of this embodiment is that the user is not confined to a predetermined set of visual effects, but can control the visual effect produced by the lamp assembly based on an external electrical signal applied to the lamp controller.

Figure 2A:
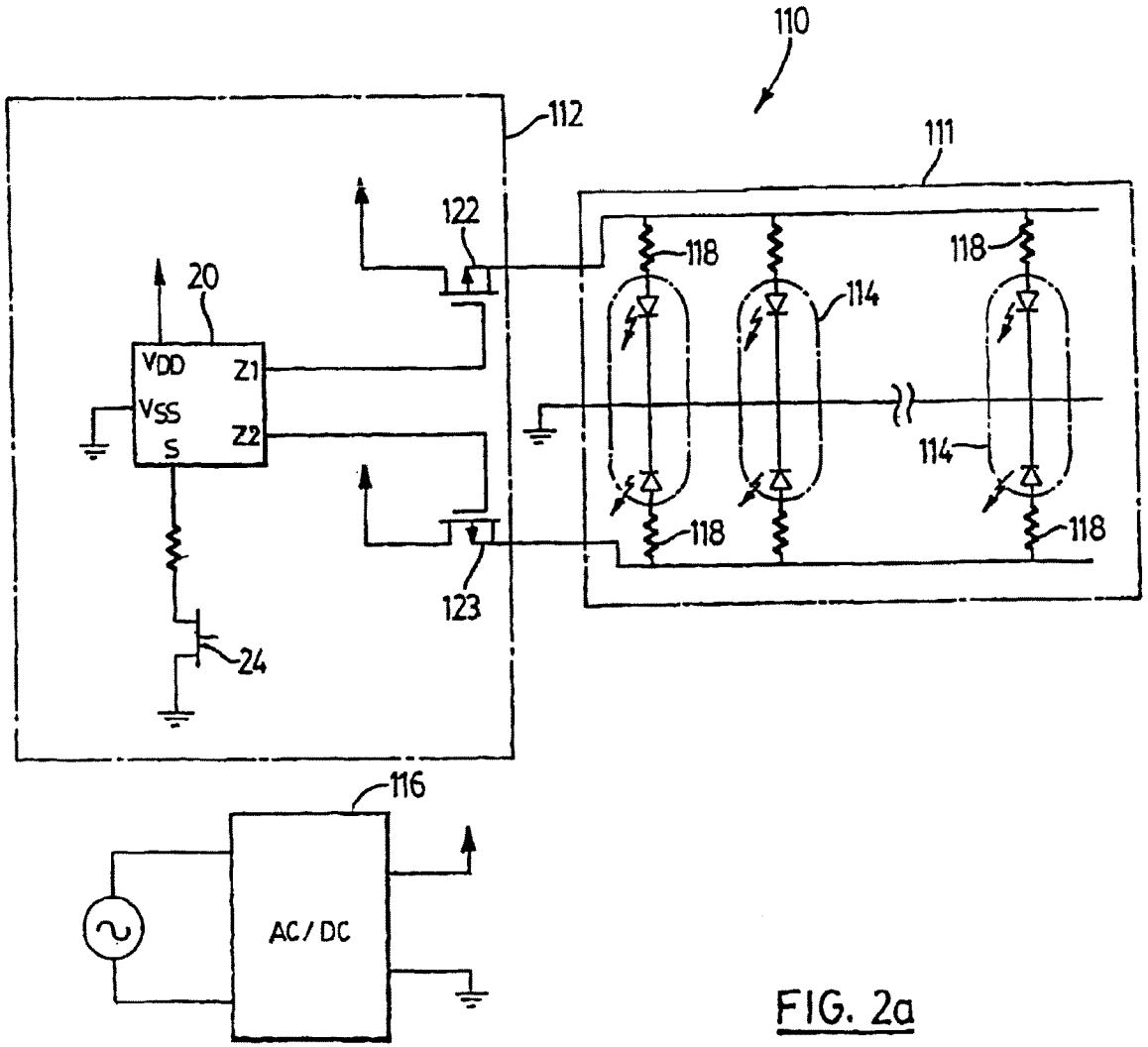
FIG. 2*a* is a schematic circuit diagram of an eighth embodiment of the variable-effect lighting system, wherein the lamp assembly comprises a string of parallel-coupled bicoloured lamps.

Turning to FIG. 2*a*, a variable-effect lighting system according to an eighth embodiment, denoted generally as 110, is shown comprising a lamp assembly 111, and a lamp controller 112 coupled to the lamp assembly 111 for setting the colour of light produced by the lamp assembly 111.

The lamp assembly 111 comprises a string of multi-coloured lamps 114 connected in parallel with each other. The multi-coloured lamps 114 are also connected in parallel with an AC/DC converter 116 which is coupled to an AC voltage source. Each lamp 114 comprises a bicoloured LED having a first illuminating element for producing a first colour of light, and a second illuminating element for producing a second colour of light which is different from the first colour, with the leads of each lamp 114 configured such that when current flows through one lead the first colour of light is produced, and when current flows through the another lead the second colour of light is produced. As shown in FIG. 2*a*, preferably each bicoloured LED comprises first and second differently-coloured LEDs 114*a*, 114*b* in series with a respective current-limiting resistor 118, with the common cathode of the LEDs 114 being connected to ground, and with the first illuminating element comprising the first LED 114*a* and the second illuminating element comprising the second LED 114*b*.

The AC/DC converter 116 produces a DC output voltage of a magnitude which is sufficient to power the lamps 114, but which will not damage the lamps 114. Typically, the AC/DC converter 116 receives 120 volts AC at its input and produces an output voltage of about 5 volts DC.

Preferably, the controller 112 is also powered by the output of the AC/DC converter 116 and comprises a microcontroller 20, a first semiconductor switch 122 controlled by an output Z1 of the microcontroller 20, a second semiconductor switch 123 controlled by an output Z2 of the microcontroller 20, and a user-operable switch 24 coupled to an input S of the microcontroller 20 for selecting the colour display desired. As discussed above, the user-operable switch 24 may be eliminated if desired. In FIG. 2*a*, the semiconductor switches 122, 123 are shown comprising MOSFET switches. However, other semiconductor switches may be used without departing from the scope of the invention.

The first semiconductor switch 122 is connected between the output of the AC/DC converter 116 and the anode of the first LED 114*a* (through the first current-limiting resistor 118), while the second semiconductor switch 123 is connected between the output of the AC/DC converter 116 and the anode of the second LED 114*b* (through the second current-limiting resistor 118). However, the anodes of the LEDs 114*a*, 114*b* may be coupled instead to the output of the AC/DC converter, with the first and second semiconductor switches 122, 123 being connected between the respective cathodes and ground. Other variations on the placement of the semiconductor switches 122, 123 will be apparent to those skilled in the art.

As with the previously described embodiments, the microcontroller 20 includes a non-volatile memory which is programmed with preferably several conduction angle sequences for setting the firing angle of the semiconductor switches 122, 123 in accordance with the sequence selected. In this manner, the conduction angles of the LEDs 114*a*, 114*b*, and hence the ultimate colour display generated by the lamps 114 can be selected. Alternately, as discussed above, the microcontroller 20 may be replaced with a dedicated integrated circuit (ASIC) that is "hard-wired" with one or more conduction angle sequences.

The operation of the variable-effect lighting system 110 is similar to the operation of the variable-effect lighting system 10. After power is applied to the AC/DC converter 116, the microcontroller 20 begins executing instructions for implementing one of the conduction angle sequences. Again, assuming that the first conduction angle sequence, identified above, is selected, the microcontroller 20 issues a signal to the first semiconductor switch 122, causing the first LED 114*a* to illuminate. After a predetermined period has elapsed, the signal to the first semiconductor switch 122 is removed, causing the first LED 114*a* to extinguish. While the LED 114*a* is conducting current, the predetermined period for the first LED 114*a* is decreased in preparation for the next cycle.

The microcontroller 20 then issues a signal to the second semiconductor switch 123, causing the second LED 114*b* to illuminate. After a predetermined period has elapsed, the signal to the second semiconductor switch 123 is removed, causing the second LED 114*b* to extinguish. While the second LED 114*b* is conducting current, the predetermined period for the second LED 114*b* is increased in preparation for the next cycle.

With the above conduction angle sequence, it will be apparent that the period of time each cycle during which the first LED 114*a* illuminates will continually decrease, while the period of time each cycle during which the second LED 114*b* illuminates will continually increase. Therefore, the colour of light emanating from the lamps 114 will gradually change from the colour of the first LED 114*a* to the colour of the second LED 114*b*, with the colour of light emanating from the lamps 114 when both the LEDs 114*a*, 114*b* are conducting being determined by the instantaneous ratio of the magnitude of the conduction period of the first LED 114*a* to the magnitude of the conduction period of the second LED 114*b*.

Figure 2B:
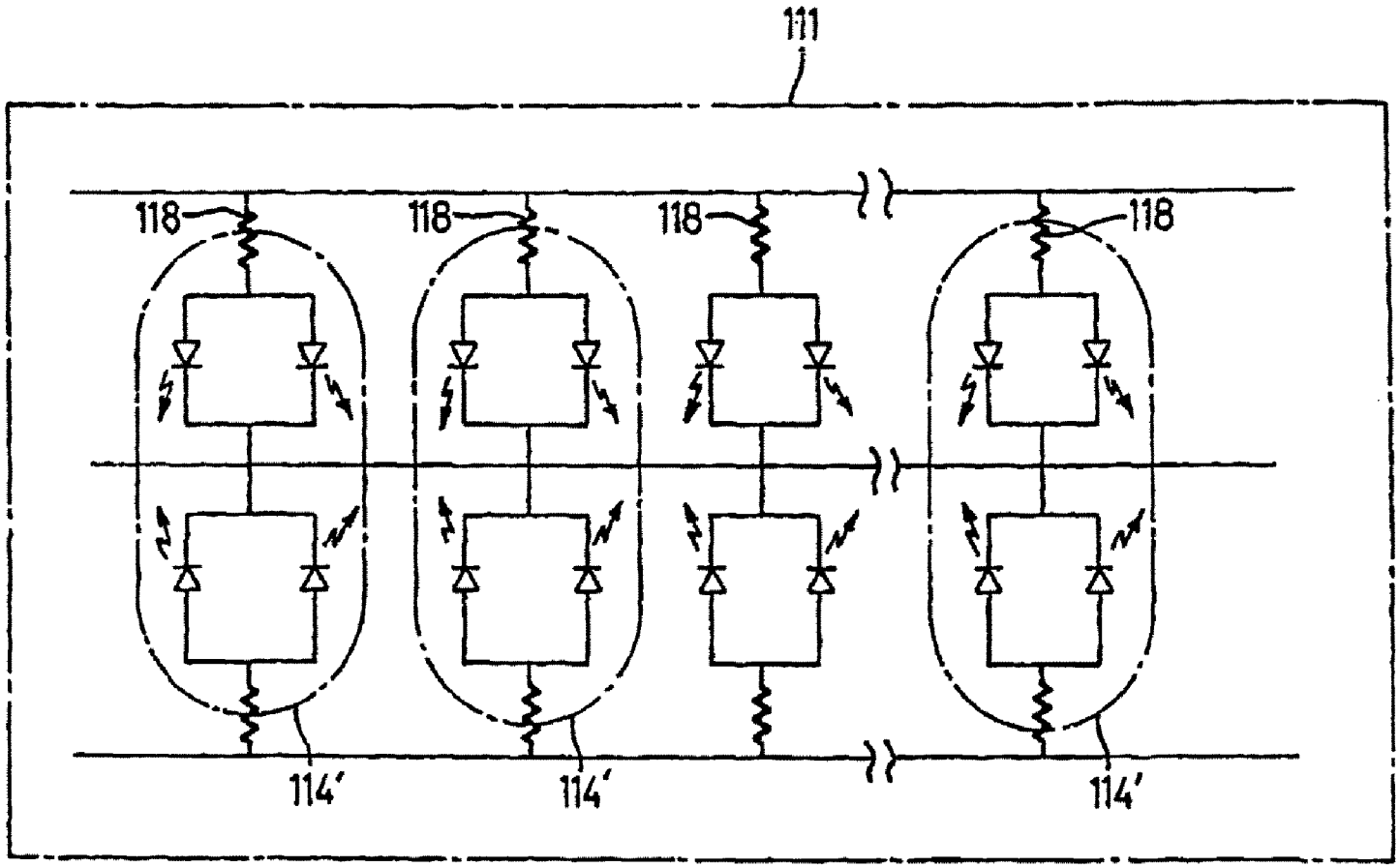
FIG. 2*b* is a schematic circuit diagram of one variation of the lamp assembly shown in FIG. 2*a;*

Numerous variations of the lighting system 110 are also possible. In one variation, each lamp 114 comprises a pair of LEDs with one of the LEDs being capable of emitting white light and with the other of the LEDs being capable of producing a colour of light other than white. In another variation, each lamp 114 comprises a LED capable of producing three or more different colours of light, while in the variation shown in FIG. 2*b*, each lamp 114 comprises three or more differently-coloured LEDs. In these latter two variations, the LEDs are connected such that when current flows through one of the semiconductor switches one colour of light is produced, and when current flows through the other of the semiconductor switches another colour of light is produced.

Figure 2C:
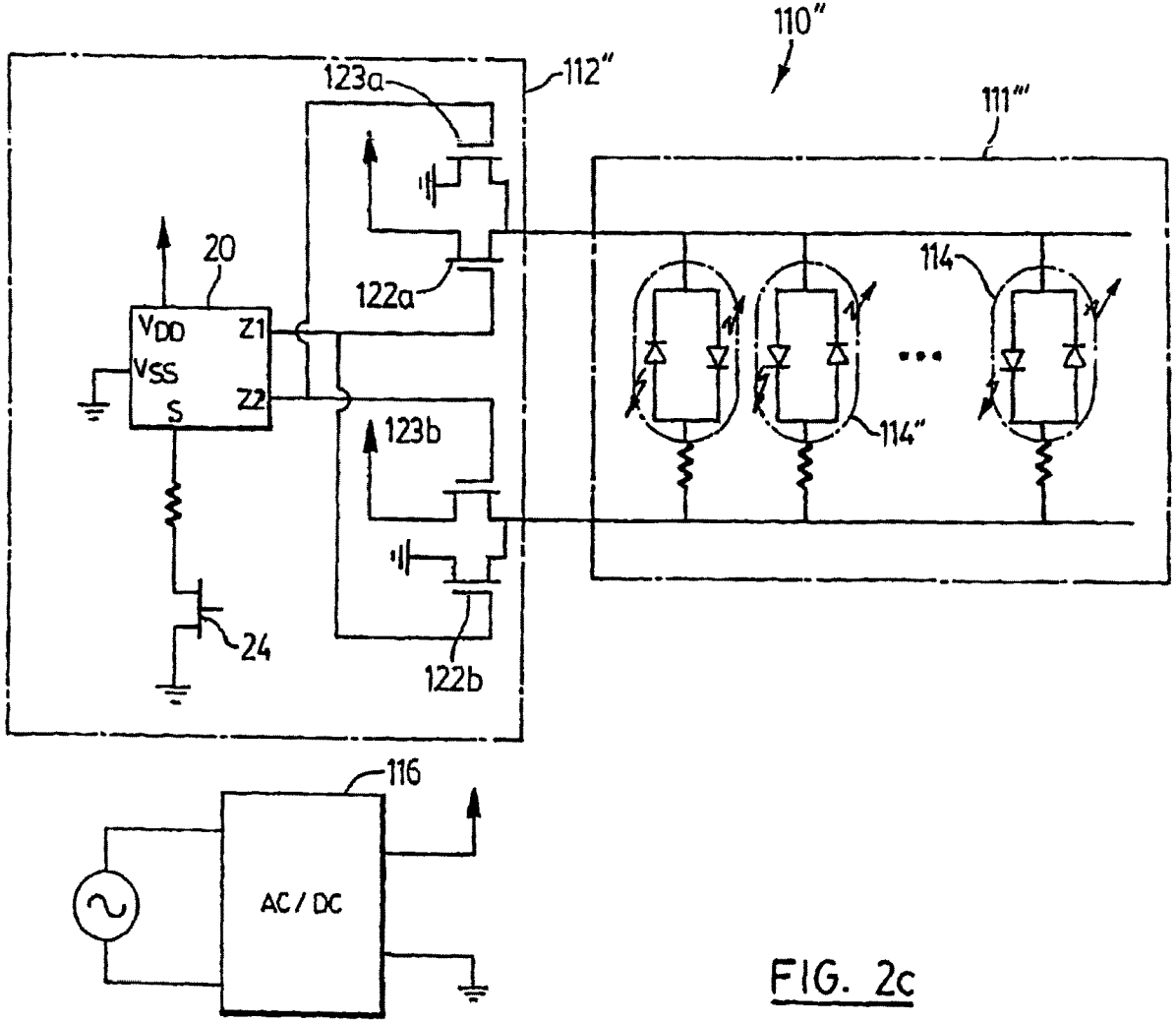
FIG. 2*c* is a schematic circuit diagram of a ninth embodiment of the variable-effect lighting system.

A ninth embodiment of the lighting system is depicted in FIG. 2*c*. As shown, the controller 112 includes a first pair of electronic switches 122*a*, 122*b* driven by the output Z1 of the microcontroller 20, and a second pair of electronic switches 123*a*, 123*b* driven by the output Z1 of the microcontroller 20. Each pair of first and second LEDs 114*a*, 114*b* of each lamp 114 are connected back-to-back, such that the lamps 114 and the semiconductor switches 122, 123 are configured together as an H-bridge. As discussed above, preferably the first and second LEDs 114*a*, 114*b* produce different colours, although the invention is not intended to be so limited.

Figure 3:
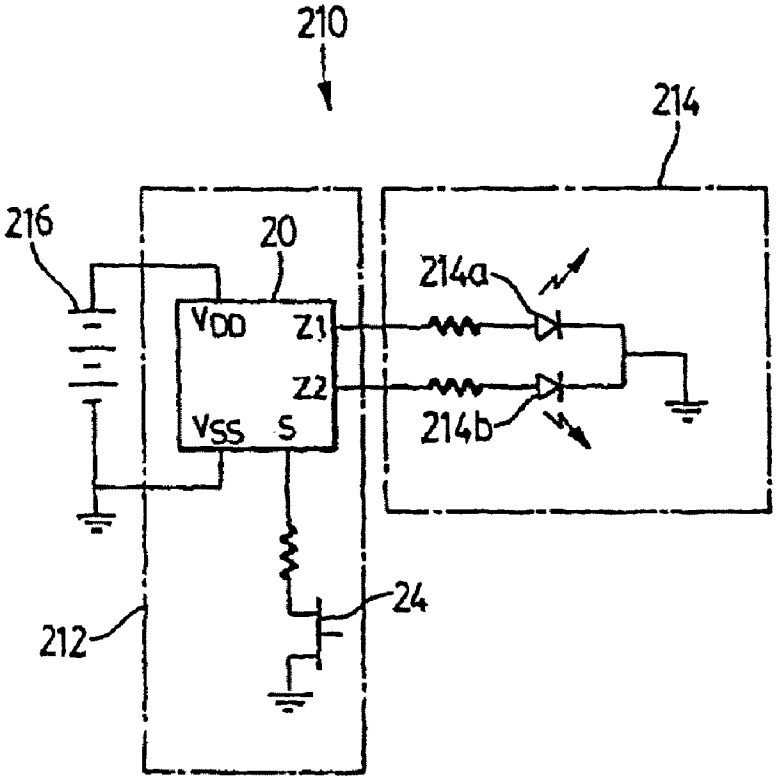
FIG. 3 is a schematic circuit diagram of a tenth embodiment of the variable-effect lighting system, wherein the lamp controller directly drives each bicoloured lamp.

Turning to FIG. 3, a variable-effect lighting system according to a tenth embodiment, denoted generally as 210, is shown comprising a multi-coloured lamp 214, and a lamp controller 212 coupled to the multi-coloured lamp 214 for setting the colour of light produced by the lamp 214. The multi-coloured lamp 114 comprises a bicoloured LED having a first illuminating element for producing a first colour of light, and a second illuminating element for producing a second colour of light which is different from the first colour. As shown in FIG. 3, preferably the first illuminating element comprises a red-coloured LED 214*a*, and the second illuminating element comprises a green-coloured LED 214*b*, with the common cathode of the LEDs 214*a*, 214*b* being connected to ground. As discussed above, multi-coloured LEDs and/or arrangements of differently-coloured discrete LEDs and/or translucent ornamental bulbs may be used if desired.

The lamp controller 212 is powered by a 9-volt battery 216, and comprises a microcontroller 20, and a user-operable switch 24 coupled to an input S of the microcontroller 20 for selecting the colour display desired. Alternately, for applications where space is at a premium, the lamp controller 212 may be powered by a smaller battery producing a smaller voltage. If necessary, the smaller battery may be coupled to the lamp controller 212 through a voltage amplifier, such as a DC-to-DC converter.

As discussed above, the microcontroller 20 may be replaced with a dedicated integrated circuit (ASIC) that is "hard-wired" with one or more conduction angle sequences. Also, the user-operable switch 24 may also be eliminated if desired.

An output Z1 of the microcontroller 20 is connected to the anode of the red LED 214*a*, and an output Z2 of the microcontroller 20 is connected to the anode of the green LED 214*b*. Since the lamp 214 is driven directly by the microcontroller 20, the variable-colour ornamental lighting system 210 is limited to applications requiring only a small number of lamps 214.

The operation of the variable-effect lighting system 210 will be readily apparent from the foregoing discussion and, therefore, need not be described.

Figure 4:
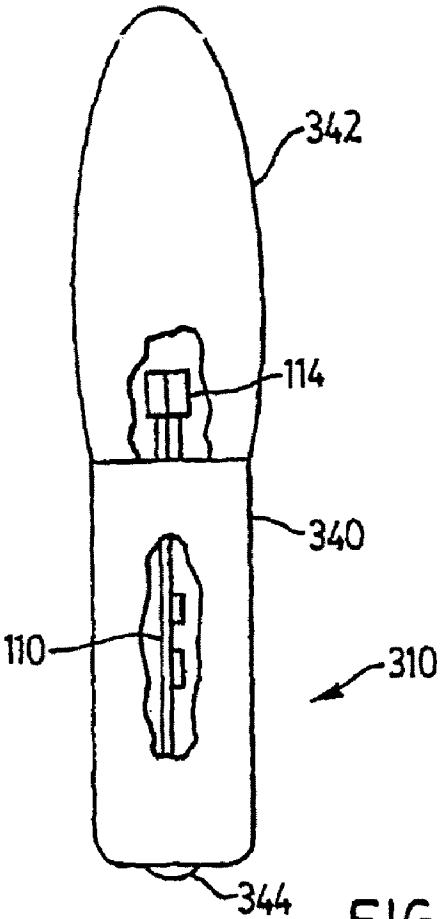
FIG. 4 is a night light according to one implementation of the embodiment shown in FIG. 2.

Turning now to FIG. 4, a night light 310 is shown comprising the variable-effect lighting system 110, described above, but including only a single multi-coloured lamp 114, a housing 340 enclosing the lamp controller 112 and the AC/DC converter 116, and a translucent bulb 342 covering the lamp 114 and fastened to the housing 340. Preferably, the housing 340 also includes an ambient light sensor 344 connected to the microcontroller 20 for inhibiting conduction of the lamp 114 when the intensity of ambient light exceeds a threshold.

Figure 5B:
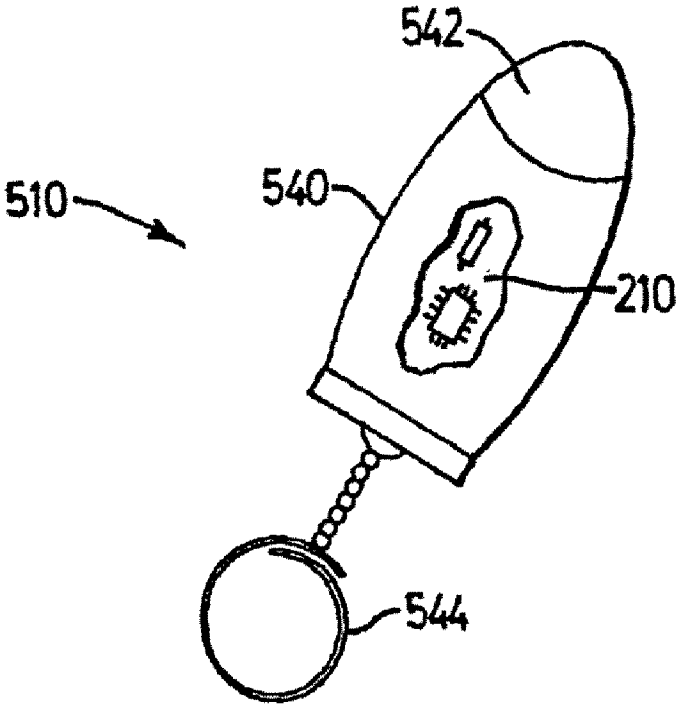
FIG. 5*b* is a key chain according to another implementation of the embodiment shown in FIG. 3.
Figure 5A:
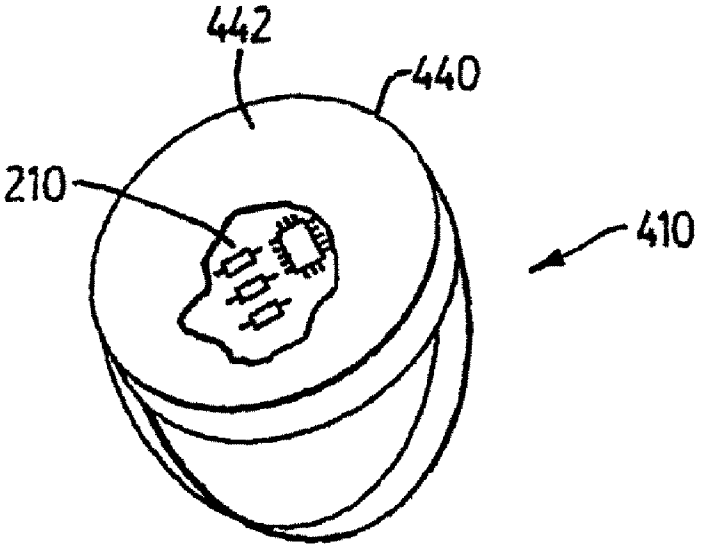
FIG. 5*a* is a jewelry piece according to one implementation of the embodiment shown in FIG. 3.

In FIG. 5*a*, a jewelry piece 410, shaped as a ring, is shown comprising the variable-effect lighting system 210, described above, and a housing 440 retaining the lamp 214, the lamp controller 212, and the battery 216 therein. A portion 442 of the housing 440 is translucent to allow light to be emitted from the lamp 214. In FIG. 5*a*, a key chain 510, is shown comprising the variable-colour ornamental lighting system 210, and a housing 540 retaining the lamp 214, the lamp controller 212, and the battery 216 therein. A portion 542 of the housing 540 is translucent to allow light to be emitted from the lamp 214. A key clasp 544 is coupled to the housing 540 to retain keys. Both the jewelry piece 410 and the key chain 510 may optionally include a user-operable input for selecting the conduction angle pattern.

The invention claimed is:

1. A variable-effect lighting system comprising:

a lamp assembly comprising a plurality of multi-coloured lamps in series with an AC voltage source and in series with each other, the voltage source having a frequency, each said multi-coloured lamp comprising a first illuminating element for producing a first colour of light, and a second illuminating element for producing a second colour of light; and a lamp controller coupled to the lamp assembly for controlling a current draw of each said illuminating element, the controller being configured to adjust the current draw in accordance with the voltage frequency.

2. The lighting system according to claim 1, wherein the lamp controller includes an electronic switch coupled to the multi-coloured lamps, the electronic switch including a diode steering section coupled to the multi-coloured lamps for equalizing an intensity of the first colour with an intensity of the second colour.

3. The lighting system according to claim 2, wherein the diode steering section comprises a first steering diode in series with a first current-limiting resistor, and a second steering diode in series with a second current-limiting resistor, the first steering diode being disposed to conduct a current through the multi-coloured lamps in a first direction and to block said current in a second direction opposite the first direction, the second steering diode being disposed to conduct said current in the second direction and to block said current in the first direction.

4. The lighting system according to claim 3, wherein the first and second current-limiting resistors comprise electronically-variable resistors, and the electronic switch comprises a resistor controller coupled to the electronically-variable resistors for controlling a magnitude of a current through each said illuminating element.

5. The lighting system according to claim 3, wherein the first and second current-limiting resistors comprise fixed resistances, and the resistance of the first current-limiting resistor is different than the resistance of the second current-limiting resistor.

6. The lighting system according to claim 2, wherein the electronic switch comprises a diode H-bridge, a thyristor coupled to the diode H-bridge, and a switch controller coupled to the thyristor for controlling a conduction interval of each said illuminating element, the diode H-bridge including the diode steering section.

7. The lighting system according to claim 2, wherein the electronic switch comprises a diode H-bridge coupled to the diode steering section, a thyristor coupled to the diode H-bridge, and a switch controller coupled to the thyristor for controlling a conduction interval of each said illuminating element, the diode H-bridge being distinct from the diode steering section.

8. The lighting system according to claim 2, wherein the electronic switch comprises an electronically-variable resistor coupled to the diode steering section, and a resistor controller coupled to the electronically-variable resistor for controlling a magnitude of a current through each said illuminating element.

9. The lighting system according to any claim 1, wherein the voltage source has a first voltage phase and a second voltage phase opposite the first phase, the first illuminating elements are configured to produce the first colour of light during the first voltage phase, and the second illuminating elements are configured to produce the second colour of light during the second voltage phase, the second colour being different from the first colour.

10. The lighting system according to claim 9, wherein each said multi-coloured lamp comprises a pair of light-emitting diodes connected back-to-back, a first light-emitting diode of the light-emitting diode pair comprising the first illuminating element and a second light-emitting diode of the light-emitting diode pair comprising the second illuminating element.

11. The lighting system according to claim 1, wherein the lamp controller includes a proximity sensor, and the lamp controller is configured to select the conduction interval of each said illuminating element according to one of proximity and motion detected by the proximity sensor.

12. The lighting system according to any claim 1, wherein the lamp controller is configured to adjust the conduction interval of each said illuminating element according to a user-operable input to the controller.

* * * * *